US007931459B2

(12) United States Patent
Louesdon et al.

(10) Patent No.: US 7,931,459 B2
(45) Date of Patent: Apr. 26, 2011

(54) TOOL FOR MANUFACTURING CERAMIC CASTING CORES FOR TURBOMACHINE BLADES

(75) Inventors: Yvon Louesdon, Taverny (FR); Serge Prigent, Asnieres sur Seine (FR); Jean-Louis Martial Verger, Bondy (FR)

(73) Assignee: SNECMA, Paris (FR)

( * ) Notice: Subject to any disclaimer, the term of this patent is extended or adjusted under 35 U.S.C. 154(b) by 123 days.

(21) Appl. No.: 12/100,526

(22) Filed: Apr. 10, 2008

(65) Prior Publication Data

US 2008/0251979 A1 Oct. 16, 2008

(30) Foreign Application Priority Data

Apr. 11, 2007 (FR) ..... 07 02640

(51) Int. Cl.
*B28B 7/10* (2006.01)
*B28B 7/16* (2006.01)
*B22C 13/00* (2006.01)

(52) U.S. Cl. ..... 425/175; 164/228

(58) Field of Classification Search ..... 425/236, 425/355, 175, DIG. 58; 264/318; 164/28, 164/228, 232

See application file for complete search history.

(56) References Cited

U.S. PATENT DOCUMENTS

2003/0015308 A1* 1/2003 Fosaaen et al. ..... 164/35
2006/0292005 A1* 12/2006 Pietraszkiewicz et al. . 416/97 R

FOREIGN PATENT DOCUMENTS

EP 0 371 895 A2 6/1990
EP 1 661 642 A1 5/2006
FR 2 827 533 1/2003

* cited by examiner

*Primary Examiner* — Matthew J Daniels
*Assistant Examiner* — Erin Snelting
(74) *Attorney, Agent, or Firm* — Oblon, Spivak, McClelland, Maier & Neustadt, L.L.P.

(57) ABSTRACT

A tool for manufacturing a casting core, for a turbomachine blade with a leading edge and a trailing edge, the core includes a thick part on the leading edge side and a thin part on the trailing edge side is disclosed. The tool includes first and second dies of the core that are moveable in a direction with respect to each other between a molding position and a demolding position, sub-components that are moveable relative to the dies, and mechanical ejectors that are provided on the first and second dies. The parts of the dies corresponding to the thin part of the core do not include a movable sub-component. The thin part of the core is demolded along the main direction of opening of the first and second dies.

6 Claims, 4 Drawing Sheets

TOOL FOR MANUFACTURING CERAMIC CASTING CORES FOR TURBOMACHINE BLADES

BACKGROUND OF THE INVENTION

The present invention relates to the manufacture of components such as metal turbomachine blades having internal cavities of complex geometry, especially those forming cooling circuits, using the technique of lost wax casting. It relates to the tool for molding the casting core for these components.

The manufacture of blades using this technique starts with the production of a pattern, made of wax or another equivalent temporary material, which comprises an internal component forming a casting core and corresponding to the cavities in the blade. To form the pattern, a wax injection mold is used in which the core is placed and wax injected thereinto. The wax pattern obtained is then dipped several times in slips consisting of a suspension of ceramic particles in order to produce a shell mold. The wax is removed and the shell mold fired. The blade is obtained by pouring a molten metal into the shell mold, said metal occupying the voids between the inner wall of the shell mold and the core. Thanks to an appropriate seal or selector and controlled cooling, the metal solidifies in the desired structure. Depending on the nature of the alloy and on the expected properties of the component resulting from the casting operation, this may be directional solidification (DS), with a columnar structure, directional solidification with a single-crystal structure (SX) or equiaxed solidification (EX). The first two families of components relate to superalloys for components subjected to high stresses, both thermal and mechanical, in the turbojet engine, such as the HP turbine blades.

Once the alloy has solidified, the shell and the core are knocked out. This results in the desired blade.

DESCRIPTION OF THE PRIOR ART

The casting cores used are made of a ceramic with a generally porous structure. They are produced from a mixture consisting of a refractory filler in the form of particles and a relatively complex organic fraction forming a binder. Examples of compositions are given in patents EP 328 452, FR 2 371 257 or FR 1 785 836. As is known, the casting cores are formed by molding in a core box using for example an injection-molding machine. This forming is followed by a binder removal operation during which the organic fraction of the core is removed by means such as sublimation or thermal degradation, depending on the materials used. This results in a porous structure. The core is then consolidated by a heat treatment in an oven. A finishing step may possibly be needed in order to remove and fettle the traces of the parting lines and to obtain the geometry of the core. Abrasive tools are used for this purpose. It may also be necessary to reinforce the core, so that it is not damaged in the subsequent cycles of its use. In this case, the core is impregnated with an organic resin.

The cores of high-pressure turbine blades of a gas turbine engine have a thin trailing edge zone. Moreover, there is a demand for components having ever thinner wall portions or zones. As a result, the filling limits of the mold are often reached and lead to the development of more fluid ceramic slurries or the modification of the injection parameters. In particular, injection flow rates or pressures higher than under the conventional conditions of use for filling the dies of the mold are employed.

However, these techniques have certain limits. The ceramic possesses abrasive properties and the shear stresses generated by the latest, severer filling conditions cause premature wear of the thin zones of the tools, resulting in an increase in the number of production stoppages and in the cost of maintaining the tools. Furthermore, the demolding operation may result in the deformation of the core when the slurry is infiltrated into the mechanisms of the core box. Thus, these core filling and demolding conditions in the core box are the source of indications of the crack and burr type which result in large quantities of cores being scrapped after they have been ejected and checked. The defects may also be revealed only after the binder-removal/firing heat treatment.

To improve the quality of filling the die, the present Applicant has proposed in patent application FR 0 651 682 to thicken the teeth of the core in the trailing edge zone and then to machine the thickened teeth so as to return to the required thickness. The teeth denote those parts of the core near the trailing edge which form, after are metal has been cast, the channels for discharging the cooling air.

SUMMARY OF THE INVENTION

Another means of remedying these manufacturing problems is now proposed in accordance with the invention with a tool for manufacturing a casting core, for a turbomachine blade with a leading edge and a trailing edge, the core comprising a thick part on the leading edge side and a thin part on the trailing edge side, the mould comprising first and second dies that can move in a direction one with respect to the other between a molding position and a demolding position, with sub-components that can move relative to the dies. This tool is noteworthy in that the parts of the dies corresponding to said thin part of the core do not include a movable sub-component, mechanical ejectors being provided on one or other of the dies, in such a way that the thin part is demolded along the main direction of opening, after the core has been injected.

The expression "thin zone" is understood to mean one having a thickness e of less than 0.5 mm. Thicknesses as low as 0.1 mm are envisioned.

The two dies can preferably move translationally between the open and closed positions. More particularly, the dies have projecting surface decorations for the formation of cavities in the core.

Optionally, a core blank may possibly be formed in the mold with a zone that is thickened relative to that as designed in the design office and to machine said thickened zone after the blank has been extracted from the mold. The operation of machining the blank may be carried out before or after heat treatment.

The invention also relates to a process for manufacturing a casting core comprising at least one thin zone, in particular a thin trailing edge, especially for a turbomachine blade, comprising the forming, in a suitable tool, of a mixture comprising a charge of ceramic particles and an organic binder, extraction from the mold, removal of the binder and consolidation heat treatment of the core, wherein a core blank with a padding part is formed in said tool and wherein said padding part is machined after the blank has been extracted from the mold, this being before or after the heat treatment operation.

Although those skilled in the art seek to develop materials with a lower viscosity or to modify the injection parameters, in particular the flow rate without forgetting the pressure, it turns out that by reducing the clearances and mechanical deformations of the mold and of the core in the thin zones it is possible for the quality of the core to be appreciably improved. Thanks to the invention, any lengthy and tricky adjustment, both initially and after each cleaning operation, for regulating the movable sub-components and any particular development regarding the wear of the molds is obviated, even with a reduction in the wall thicknesses down to 0.1 mm on the core delivered.

Thanks to the invention, the costs involved in obtaining and operating the core boxes or mold, and consequently the casting cores, are thus reduced. Although the quantity of cores exhibiting indications of the demolding injection crack, firing crack and injection burr type, obtained by injection molding in a mold with a thin trailing edge amounts to several tens of %, the solution enables the better level of quality of the cores to be rapidly obtained, eliminates the burrs associated with the clearance of the sub-components of the core box and reduces the vagaries in the manufacture of cores having thin trailing edges. The intended limit of the thicknesses drops to 0.1 mm.

The material constituting the core preferably comprises 80 to 85% of a mineral filler and 15 to 20% of an organic binder. Advantageously, the composition corresponds to one of those described in the Applicant's patent EP 328 452, in particular the least fluid composition, but also that having the smallest shrinkage variation when mass-producing the cores.

BRIEF DESCRIPTION OF THE DRAWINGS

Other features and advantages will become apparent on reading the following description of a method of implementing the process of the invention with reference to the appended drawings in which.

DESCRIPTION OF THE PREFERRED EMBODIMENTS

The following description corresponds to the application of the invention to the formation of a casting core for a high-pressure turbine blade in a gas turbine engine for aeronautical or terrestrial use. This example is not limiting.

Figure 1:
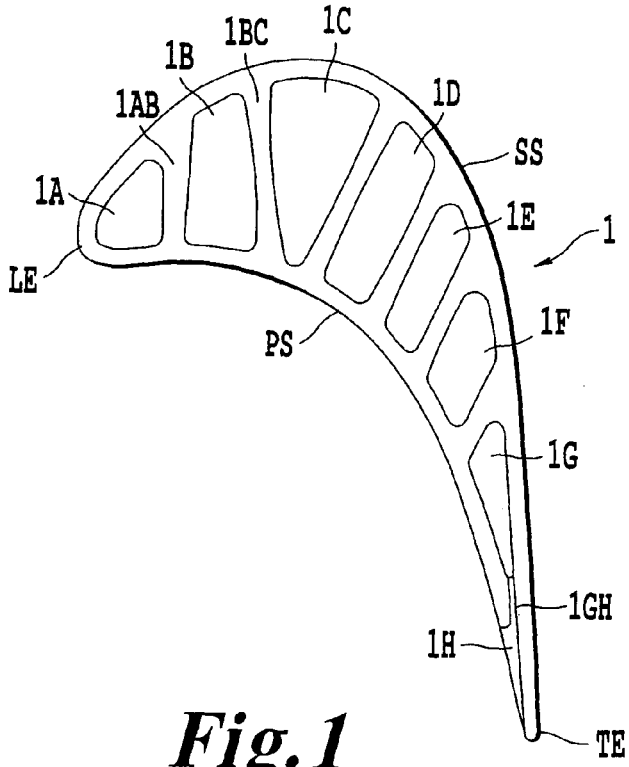
FIG. 1 is a sectional view of a cooled turbine blade with its narrow trailing edge zone.

As may be seen in FIG. 1, such a turbine blade 1 comprises a pressure side PS, a suction side SS, a leading edge LE and a trailing edge TE. The blade includes several, here seven, internal cavities: 1A to 1G. The cavities are separated from one another by partitions: 1AB, 1BC, etc. The trailing edge has an opening 1H or a plurality of openings over its length, said openings being fed from the last cavity 1G via mutually parallel channels 1GH' for discharging the coolant into the gas stream. The coolant consists of air bled off from the compressor.

Figure 2:
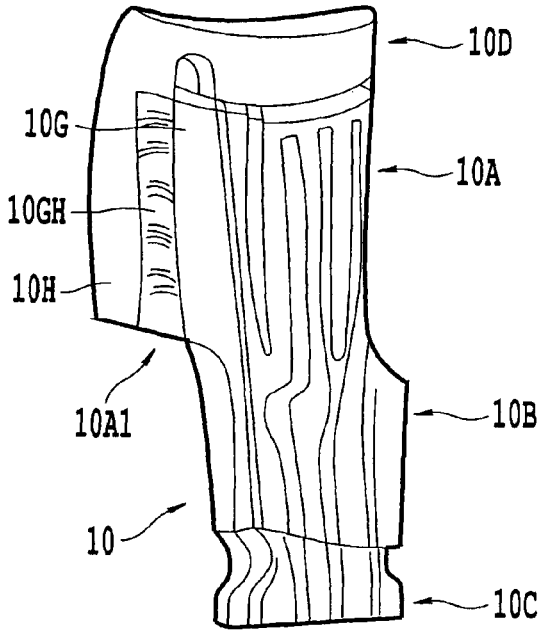
FIG. 2 is a perspective view of the core of the blade of FIG. 1.

When this type of blade is manufactured by casting a molten metal in a shell mold, a core that occupies the voids of the cavities to be formed in the blade must be incorporated into said mold. This core 10, shown schematically in FIG. 2, has a complex geometry. It comprises a part corresponding to the cavities of the airfoil 10A, a part 10B corresponding to the cavities of the blade root and a part 10C forming a handle for gripping the blade during manufacture. At the tip of the airfoil there is also a part 10D corresponding to what is termed a squealer in the jargon of the field. This part is separated here from the part 10A by a transverse recess. This recess forms the bottom wall of the squealer after casting.

In particular, it comprises a thin zone 10A1 corresponding to the trailing edge. In the example shown in FIG. 1, this part encompasses the portion 10G in part and the portions 10GH and 10H. 10G is that part of the core forming the cavity 1G of the blade. 10GH is that part of the core corresponding to the channels 1GH, and 10H corresponding to the cavities 1H. The thin zone generally extends over a few millimeters from the edge of the core corresponding to the trailing edge.

It will be recalled that the molds usually consist of two dies—one the lower die and the other the upper die—which are pressed tightly against each other during casting and then separated so as to allow the cast component to be extracted. Unlike other processes in which the mold is lost (sand casting or lost wax casting, etc.), it is imperative to ensure that the injected components do not remain jammed in the dies and that, on the contrary, they can be extracted therefrom without any damage. Surfaces parallel to the extraction direction are avoided—they differ from said extraction direction by an angle called the "taper", which may vary from 3 to 5 degrees. Certain parts that are difficult to extract require a system of sliding rods called ejectors. Moreover, the geometry of the component to be cast may include reverse tapers and prevent demolding by simply moving the lower and upper die apart in the demolding direction. The dies then include, for these reverse taper parts, movable sub-components arranged so as to ensure demolding.

Figure 3:
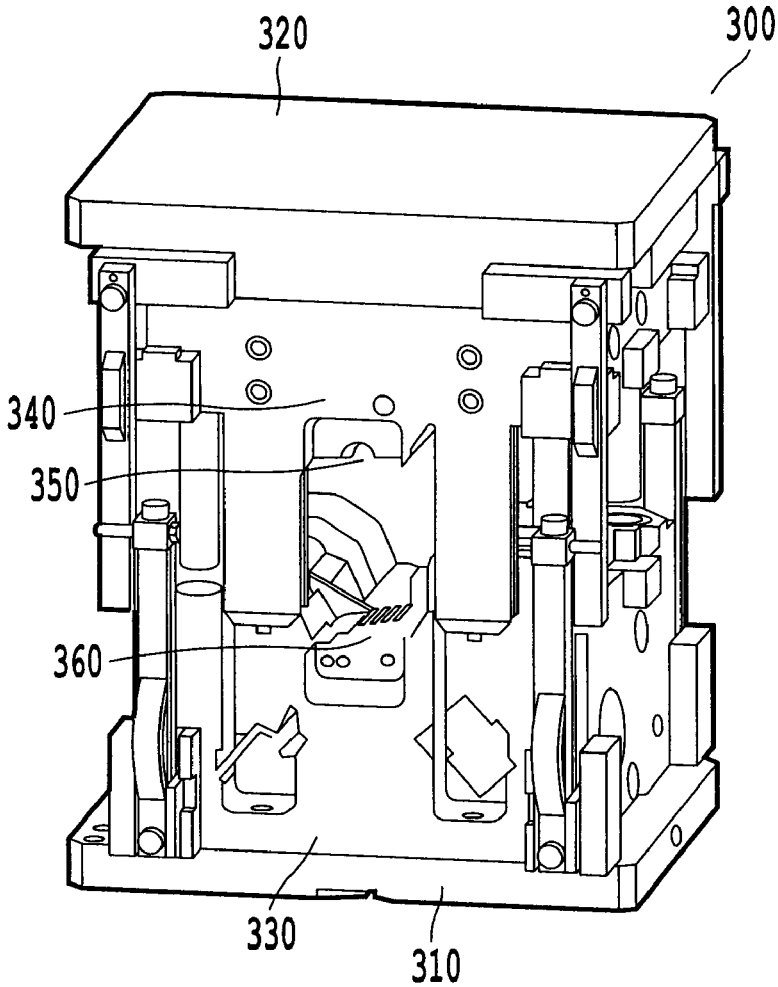
FIG. 3 is a view of an open core box.

FIG. 3 shows an injection box 300, forming a core mold, in the open position. It comprises a lower platen 310 and an upper platen 320 fixed to the lower and upper dies respectively of the injection molding machine (not shown). This type of box comprises two dies, one called the lower die 330 and the other the upper die 340. When the box is in the closed position, the slurry (a mixture of polymer and ceramic) is injected via an injection channel 350, which slurry fills the space 360 for the core. Each die has on its internal wall relief elements forming the decorations for reserving the hollow parts of the core.

Figure 4:
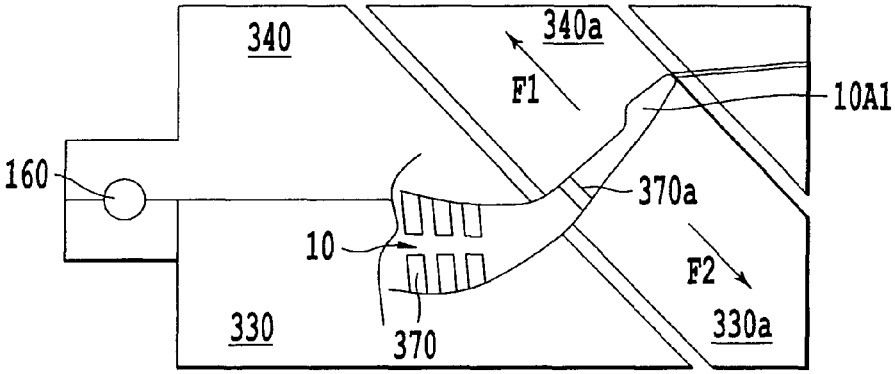
Fig.4 BACKGROUND ART
FIG. 4 is a section showing the principle of a core box according to the prior art, that is to say one having oblique movable sub-components at the trailing edge.

FIG. 4 shows in cross section the part of a conventional mold for a turbine blade core 10. It comprises dies 330 and 340 with decorations 370 for the cavities intended to provide the partitions of the finished blade. The curvature of the core along its chord is large. The direction of that part of the core which is located at the trailing edge makes an angle of around 45 to 60 degrees to the direction of the thicker part located on the leading edge side. This curvature does not allow dies to be produced without a movable sub-component since it is not possible to avoid the reverse-taper parts.

The usual technique consists in designing the dies of the mold with sub-components 330*a* and 340*a* at the trailing edge 10A1 of the core 10 which have a certain mobility, indicated by the arrows F1 and F2. Usually, the number of partitions having the same orientation in the solid part of the core is higher than in the direction of the decorations on the trailing edge. In the prior art, the movable sub-component is therefore reserved for the trailing edge outlets and for direct demolding of the lower and upper dies in the solid part of the core. By means of the invention, the tool is simplified in its critical part at the trailing edge and the movable sub-components are kept in the zones that are thicker and simpler to obtain. The decorations 370*a* on the sub-components are tapered in the direction of the arrows. They allow the core to be extracted after the material has been injected into the mold.

As explained above, injecting material into this zone 10A1 is more tricky the thinner it is. It is necessary to increase the pressure, but the slurry then gets into the clearances between the movable components more easily. Moreover, the mobility also results in deformations on this part of the core.

The object of the invention is to produce a core comprising thin zones having such a complex structure without in particular these zones deforming during the injection and demolding operations.

Deformations result in the appearance of cracks in the thin zones or burrs in the mechanisms of the core box. The cracks lead to the core being scrapped. The burrs accelerate the wear of the core box and increase the number of production stoppages. Wear of the core box reduces its lifetime.

In accordance with the invention, a modified mold is constructed, that is to say in which certain zones which were movable in the die now become stationary.

Such a mold comprises (FIG. 5) a lower die 530 and an upper die 540 between the two platens 560 and 580 of the injection molding machine. The core 10 is injected into the space provided between the two dies. Decorations 510 penetrate the core so as to reserve the partitioned cavities therein. In this figure, only the trailing edge 10A1 of the core 10 is seen. Ejectors 570 are provided in the lower die 530 under the part of the trailing edge 10A1.

The other part of the core has not been shown. This is thicker and the dies in this part are capable of having movable sub-components. The axis of the decorations 510 is directed along the main direction of opening of the tool, indicated by the arrows F'1 and F'2. The decorations 510 on the trailing edge are demolded thanks to mechanical ejectors 570 sliding along the axis of the arrows, here vertically. These are metal rods that are actuated from outside the mold. They are located in the lower part 530 of the mold.

Figure 5:
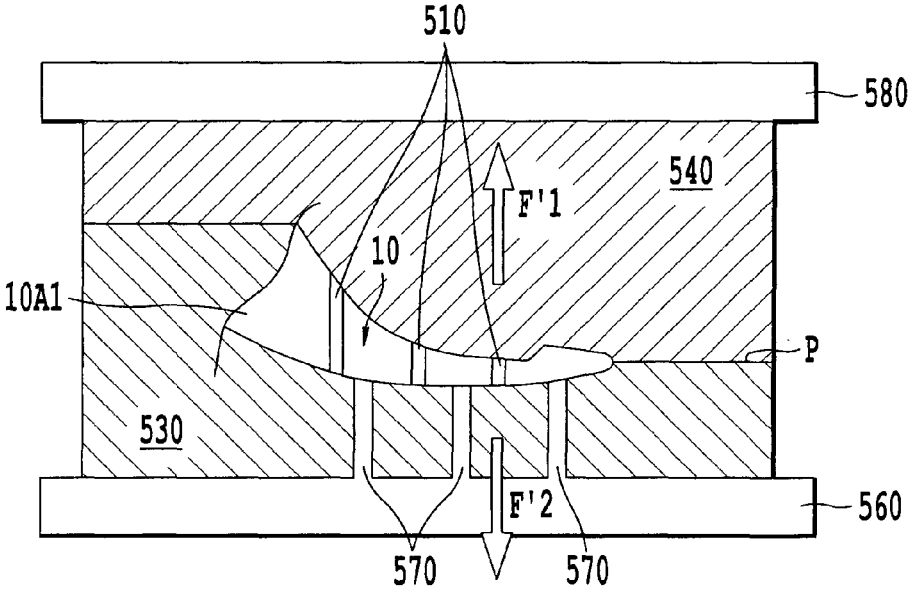
FIG. 5 is a section showing the principle of a core box in the thin zones according to the invention.

Preferably, the mold no longer has a hinge, unlike the prior art, (see reference 160 in FIG. 4), but may be fastened to the upper 580 and lower 560 platens of the injection molding machine, as illustrated in FIG. 5.

To manufacture the core with this tool, the following steps are carried out:

- the two dies 530 and 540 are placed in the injection molding machine along the parting line P;
- the slurry is injected into the space left free by the dies;
- after the slurry has been injected and the core 10 formed, the upper die is separated from the lower die along the directions F'1 and F'2, the core 10 remaining bonded to the lower die; and
- the core is extracted using ejectors 570 which apply upward pressure on the part 10A of the core.

A sufficient number of ejectors is determined, these being distributed so as to ensure a low pressure at their point of contact with the core. This distribution of the total pressure as several low pressures prevents any buckling of the core as it is being ejected. In addition, the ejectors maintain a direction as parallel as possible to the demolding axis.

Figure 6:
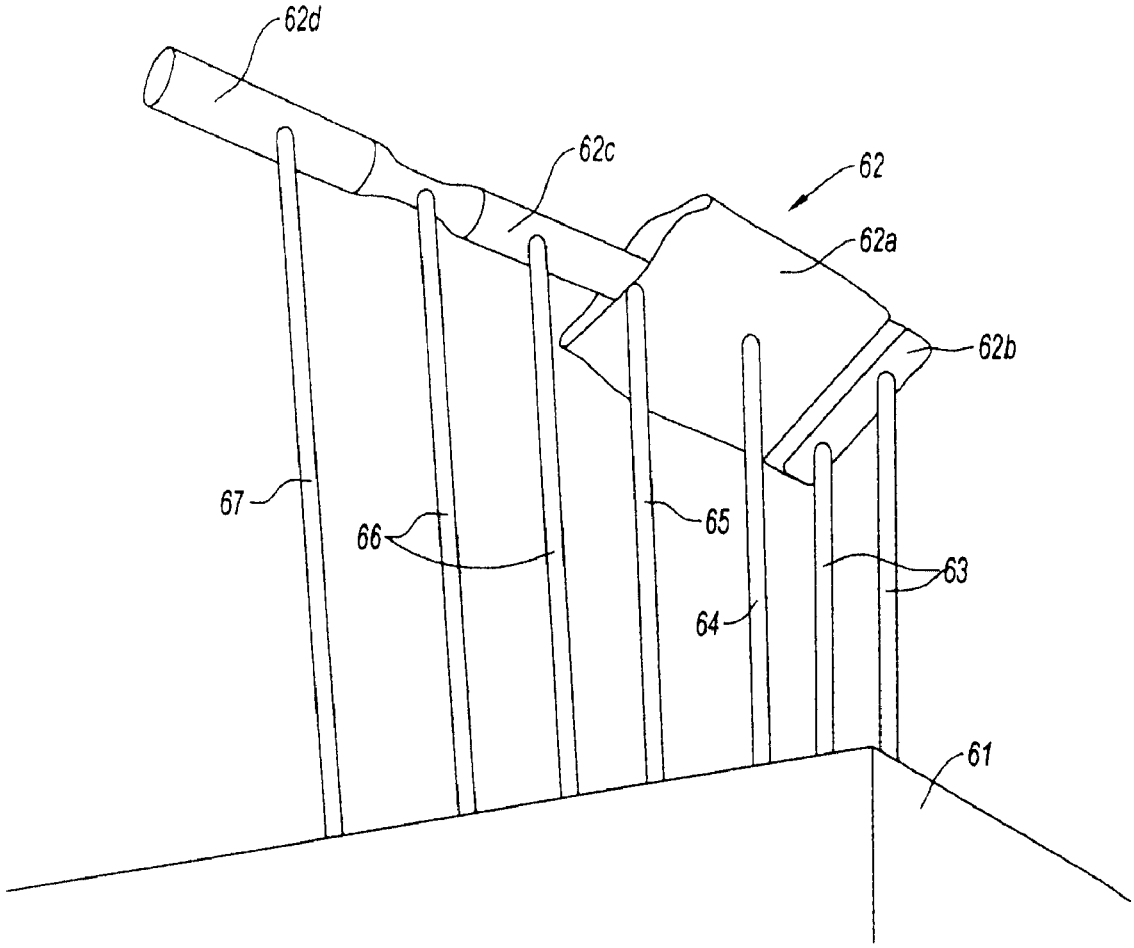
FIG. 6 illustrates the principle of the action of the ejectors on the ceramic core.

An example of the distribution of the ejectors and their points of contact with the core is shown in FIG. 6. The base 61 of the injection mold is shown in the lower part of the figure—the lower half-part of the mold is not shown so as to reveal the ejectors over their entire length. The core 62 comprises the core body 62*a*, the squealer 62*b*, the root of the core 62*c* and the feed sprue 62*d*. It may be seen that the ejectors are distributed over the entire core 62 and that, in the figure, there are seven of them, namely two ejectors 63 for the squealer 62*b*, one ejector 64 for the core body 62*a*, one ejector 65 for the root/core body join zone, two ejectors 66 for the core root 62*c*, and one ejector 67 for the injection sprue 62*d*. The ejectors 63 to 67 impose an upward movement on the ceramic core 62 and lift it from the die.

To manufacture the core, a suitable mixture is produced. This is in particular a mineral filler combined with an organic binder. For example, the mixture is made according to the teaching of patent application EP 328 452. The core has good handleability and its construction allows work to be carried out thereon, by means of a milling cutter, by chip removal or by abrasion.

In the case in which the trailing edge is injected with thickened teeth, as reported in patent application FR 0651682 by the present Applicant, the following step consists in machining, in this blank 10, the thickened zones that are added in the mold.

Once the contours of the core have been completed, where appropriate by machining, before firing, the next treatments, known per se, in the casting core manufacturing process are carried out. As regards the binder removal, that is to say the removal of the organic binder, the core is heated to a temperature high enough to degrade the organic components that it contains. The other steps consist in then heating the core to the temperature for sintering the ceramic particles of which it is composed. If additional consolidation is required, the core is impregnated with an organic resin.

For cores that are machined after firing, these pass directly to the finishing and checking operations.

The invention claimed is:

1. A tool for manufacturing a casting core, for a turbomachine blade with a pressure side, a suction side, a leading edge and a trailing edge, the core comprising a thick part on the leading edge side and a thin part on the trailing edge side, the tool comprising:

- first and second dies of the core that are moveable in a direction with respect to the each other between a molding position and a demolding position;
- sub-components that are moveable relative to the dies; and
- mechanical ejectors which are provided on one of the first or second dies,
- wherein the dies on said thin part are free of a movable sub-component,
- wherein the thin part is demolded along a main direction of opening of the first and second dies,
- wherein said thin part is substantially perpendicular to the main direction of opening of the first and second dies,
- wherein the dies include decorations for the formation of cavities in the core, and
- wherein a main axis of the decorations in the dies corresponding to the trailing edge extending from the pressure side on the first die to the suction side on the second die is substantially parallel to the main direction of opening of the first and second dies.

2. The tool as claimed in claim 1, wherein the two dies are moveable translationally between the molding position and the demolding position.

3. The tool as claimed in claim 1, wherein at least one of the two dies a location corresponding to the thin zone, is shaped so as to obtain padding parts which locally facilitates filling of the mold at injection, and the padding parts are machined to reduce their thickness.

4. The tool as claimed in claim 1, wherein the dies on the thick part include the moveable sub-components.

5. The tool as claimed in claim 1, wherein the ejectors move substantially parallel to the main axis of the decorations in the dies corresponding to the trailing edge.

6. The tool as claimed in claim 5, wherein the main axis of the decorations in the dies corresponding to the trailing edge extend in a vertical direction.

* * * * *

UNITED STATES PATENT AND TRADEMARK OFFICE

CERTIFICATE OF CORRECTION

PATENT NO. : 7,931,459 B2
APPLICATION NO. : 12/100526
DATED : April 26, 2011
INVENTOR(S) : Louesdon et al.

It is certified that error appears in the above-identified patent and that said Letters Patent is hereby corrected as shown below:

Column 6, line 2, after "of two dies" insert --in--.

Signed and Sealed this
Sixteenth Day of August, 2011

David J. Kappos

David J. Kappos
*Director of the United States Patent and Trademark Office*